US005481859A

United States Patent [19]

Mann et al.

[11] Patent Number: 5,481,859

[45] Date of Patent: Jan. 9, 1996

[54] TEXTILE MACHINE FRAME WITH BRIDGE PLATES BETWEEN STANDS

[75] Inventors: Peter Mann, Süssen; Kurt Hack, Ebersbach; Thomas Benkert, Deggingen, all of Germany

[73] Assignee: Zinser Textilmaschinen GmbH, Ebersbach/Fils, Germany

[21] Appl. No.: 347,603

[22] Filed: Dec. 1, 1994

[30] Foreign Application Priority Data

Dec. 1, 1993 [DE] Germany ..... 43 40 965.2

[51] Int. Cl.[6] ..... D01H 5/56; D01H 7/40

[52] U.S. Cl. ..... 57/1 R; 19/294; 57/75; 57/90; 57/136; 57/315

[58] Field of Search ..... 57/1 R, 90, 75, 57/136, 315; 19/236, 294

[56] References Cited

U.S. PATENT DOCUMENTS

| | | | |
|---|---|---|---|
| 2,490,803 | 12/1949 | Harriagn et al. | 57/315 |
| 2,557,658 | 6/1951 | Hoffman | 57/136 |
| 4,012,810 | 3/1977 | Stahlecker | 19/294 |

FOREIGN PATENT DOCUMENTS

| | | | |
|---|---|---|---|
| 1971929 | 11/1967 | Germany . | |
| 2422422 | 11/1975 | Germany . | |
| 2656537 | 6/1978 | Germany . | |
| 2705553 | 8/1978 | Germany . | |
| 666216 | 6/1979 | U.S.S.R. | 57/1 R |
| 921410 | 3/1963 | United Kingdom | 19/294 |
| 2233354 | 1/1991 | United Kingdom . | |

*Primary Examiner*—William Stryjewski
*Attorney, Agent, or Firm*—Herbert Dubno

[57] ABSTRACT

A stiff mounting unit is formed by a pair of longitudinal main girders and support bars for a two sided spinning or twisting machine frame. Bridge pieces are connected to these bars and girders. The support rollers and pressing rollers of the drafting or feed units are mounted on the bars.

11 Claims, 3 Drawing Sheets

TEXTILE MACHINE FRAME WITH BRIDGE PLATES BETWEEN STANDS

FIELD OF THE INVENTION

The present invention relates to a textile machine, namely, a spinning or twisting machine and especially to a textile machine frame for a two-sided machine frame in which spinning and twisting stations are provided on both sides of the frame and such stations are associated with a drafting frame or supply frame having rollers over which the yarn or roving may be fed and which cooperate with rollers on a pressing arm which bear against the yarn or roving. More particularly this invention relates to a spinning or twisting machine having intermediate stands, i.e. uprights supported on the floor and spaced along the length of the machine frame between the ends thereof, which are spanned by a girder means extending from one intermediate stand to the next intermediate stand along the length of the machine, the girder means carrying stamped out bridge plates having portions on opposite sides of the machine for carrying the support rollers and on which the holding bars are provided for the pressing arms with the pressing rollers of the drafting and supply units.

BACKGROUND OF THE INVENTION

In a prior art construction of drafting frames for spinning machines and the like, the support and loading arms for the upper rollers of the drafting units are mounted on holding bars which are connected to the bridge plates which are individual to that drafting unit. One of the problems with such a design is that the stability of the machine is limited and, indeed, the stiffness of the drafting frame and the stiffness of the entire machine frame leaves much to be desired, especially when the distances between the intermediate stands is large. In fact, as a practical matter, in such systems the spacing between the intermediate stands cannot be increased over about 1200 mm without creating problems.

In British Patent Document GB 2 233 354, a system is described in which the holding bars for the swingable pressing arms of the drafting units span between the intermediate stands, i.e. run from one intermediate stand to another.

Here, however, no bridge pieces or plates are provided and again there is a limit to the spacing between the intermediate stands which is significantly less than is desirable and even smaller than other conventional designs.

A drafting frame system for spinning machines is described in German Patent Document DE-OS 24 22 422 in which the supporting parts of the drafting units are so formed that a large number of drafting units can be mounted. The longitudinal supporting member in this case includes a holding bar which is at least twice as long as the distance between two stamped pieces. The holding bars extend through intermediate stands in which the stamped pieces and the supporting and loading arms of the drafting units are held. In this case, the holding bars are not supported by the stamped pieces but rather the stamped pieces must be held by the holding bars. The resulting drafting frame or the machine frame in the mounted state of the drafting frame generally cannot be reinforced as to stiffness and often is insufficiently stiff to satisfy modern requirements as to the lengths of the textile machine.

In another arrangement of drafting units on a spinning machine (see German Patent Document DE-OS 26 56 537) premounted drafting units are provided as well.

In one embodiment, the stamped pieces are connected by a longitudinal profiled element in the form of an auxiliary drafting rail. The holding bars extend only from stamped piece to stamped piece and the unit extends as disclosed only along one side of the machine.

German Patent Document DE-GM 1 971 929 describes a so-called bridge plate, also produced by stamping, which extends to both sides of the machine of a two-sided ring spinning machine and which is supported by girder means in the form of a pair of tubular girders constituting the supporting member.

OBJECTS OF THE INVENTION

It is therefore an object of the present invention to provide an improved spinning or twisting machine which has advantages of the machine frame described in the last mentioned German patent document, is provided with drafting or feed units and has improved stiffness over earlier machine frames and textile machine constructions.

Another object of the invention is to provide an improved machine frame for a textile machine so that the latter will have greater stiffness at least in the region of the drafting units and which allows an increase in the spacing between the intermediate stands and hence a reduction in the number of them.

Still another object of this invention is to provide an improved machine frame for a spinning or twisting textile machine which can sustain greater distances between the support stands by which the machine is mounted on the floor, but which has improved support for the drafting or feed units of the machine.

SUMMARY OF THE INVENTION

The machine frame of the present invention, starting from the frame of DE-GM 1 971 929, provides that the holding bars also extend in one piece between the two intermediate stands and that the holding bars and the two main girders are interconnected by at least one bridge plate between each two intermediate stands the holding bars carrying the support rollers and, of course, the pressing or loading arms and the upper rollers of the drafting units or yarn or roving said units of the textile machine. As a consequence, in a relatively simple manner a substantial increase in the stiffness of the machine frame is insured which can allow a reduction in the number of intermediate stands and hence a substantial cost saving to be obtained. The assembly of the machine is, of course, likewise simplified.

According to the invention, therefore, a frame for a double sided spinning or twisting machine can comprise:

- a plurality of upright support stands spaced apart over a length of the machine and extending upwardly from a floor on which the stands support the machine;
- main girder means extending horizontally and including at least one main girder extending parallel to a longitudinal vertical median plane of the machine perpendicular to the upright support stands and continuously from one support stand to a following support stand along the length of the machine;
- at least one stamped bridge plate supported above the ground on the main girder means between each two successive support stands and lying in a plane perpendicular to the at least one main girder to opposite sides of the median plane and opposite working sides of the machine; and respective support bars on opposite sides of the machine carried by the bridge plate, each of the support bars extending in one piece between the two successive support stands and serving to mount support arms with respective supply or drafting rollers and respective loading arms assigned to the support arms with pressing rollers bearing upon the supply or drafting rollers of a respective yarn drafting or supply mechanism.

The main girder means can comprise two longitudinal girders so that the longitudinal girders and the holding bars or supporting bars can be connected to the or each bridge plate at the vertices or corners of a trapezoid, especially an isosceles trapezoid.

According to another feature of the invention, the two main girders, the two holding or support bars and at least two bridge plates interconnecting these girders and holding bars, spaced apart from one another and adapted to be disposed between two intermediate stands can form a unit which can be easily handled and mounted as a unit on the stands to form the machine frame.

Where n drafting units or stations are provided between two intermediate stands (n being a whole number between 1 and at most 6), the invention allows a number of possibilities:

The mounting unit may have n−1 bridge plates, equally spaced along that unit, with free ends of the longitudinal main girders and the continuous support bars projecting beyond the last bridge plates and mounted in the intermediate stands between which the unit is disposed.

Alternatively, the mounting unit may have n bridge plates, one of which is a terminal bridge plate then mounted the unit on the respective stands.

According to a feature of the invention the main girders are connected to the bridge plate by clamping them thereagainst with a clamping plate, the support bars being connected to the bridge plate by screws.

According to the invention the support arms with respective supply or drafting rollers and respective loading arms assigned to the support arms with pressing rollers bearing upon the supply or drafting rollers are mounted on the support bars as premounted units before the support bars and the bridge plate are secured between the stands.

Preferably the main girders are tubular and of circular cross section.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
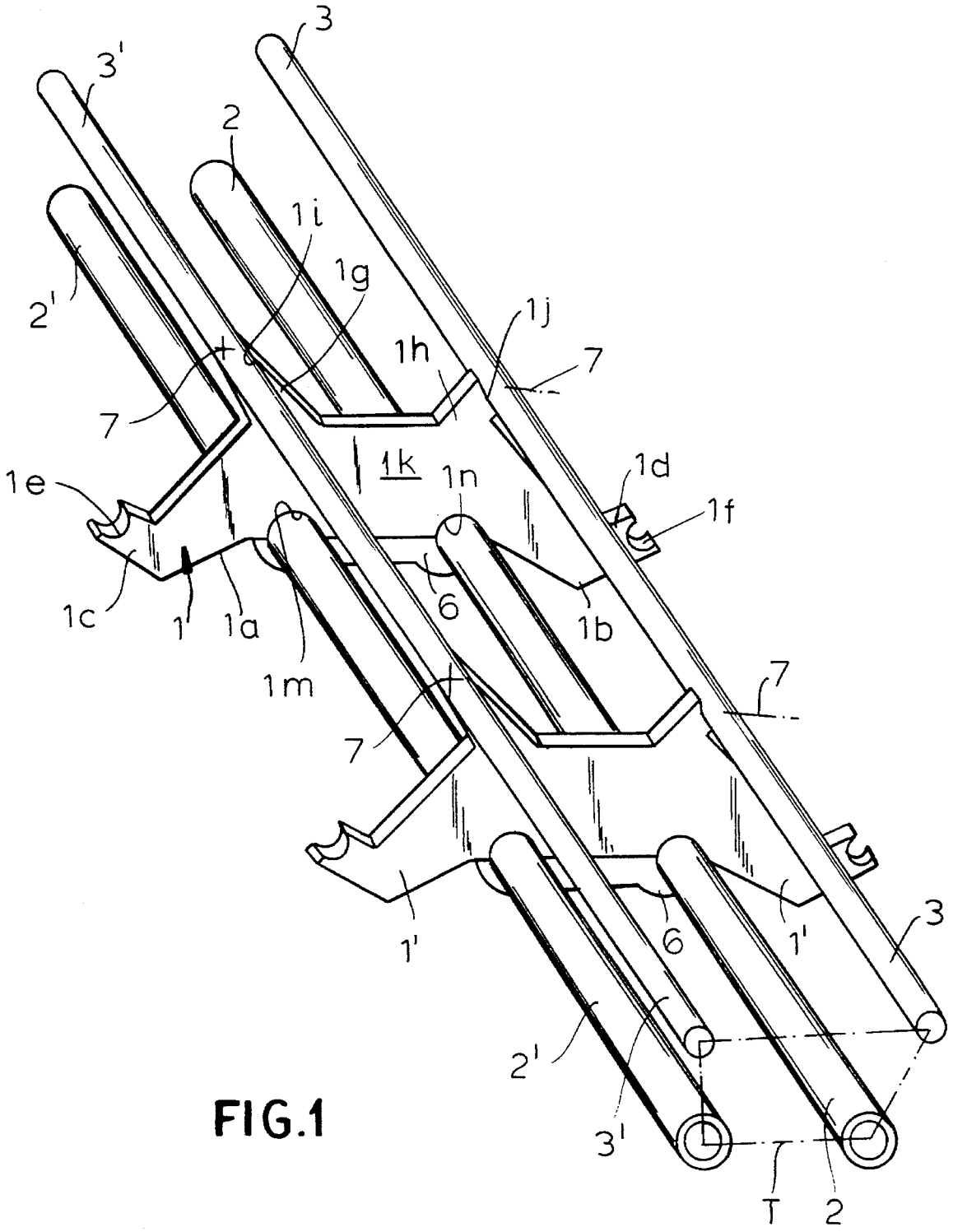
FIG. 1 is a perspective view of two main girders and two support bars held together by a pair of bridge plates as a unit for insertion as such between a pair of intermediate stands.

The machine frames illustrated in the drawing and described below are parts of spinning or twisting machines with drafting or supply mechanisms whose support rollers underlie the yarn or roving and which have loading or pressing arms which press against the roving and yarn from above to grip the roving or yarn between upper and lower rollers as will be described in greater detail in connection with FIG. 5.

The unit which is provided between a pair of stands, according to the invention, is shown in FIG. 1 in a perspective view and can be seen to comprise two bridge plates 1 and 1'. These bridge plates 1 and 1' are spaced apart by a distance equal to the spacing of the bridge plates from respective ends of the units and hence from respective stands. The bridge plates 1 and 1' are stamped from steel plate. They have, as will be apparent from FIG. 1, a pair of downwardly and outwardly extending main arms 1*a* and 1*b*, each of which has an upstanding projection 1*c* and 1*d* formed with a semicylindrical seat 1*e* and if adapted to receive a bar forming part of the drafting unit. That bar may extend continuously along the unit shown in FIG. 1.

A pair of upwardly and outwardly extending arms 1*g* and 1*h* can likewise have seats 1*i* and 1*j* in which the support bars 3, 3' can be received.

The arms are connected to a central web 1*k* formed at its bottom with semicylindrical seats 1*m* and 1*n* in which the longitudinal girders 2 and 2' can be received.

The two bridging plates 1 and 1' are thus interconnected by means of the longitudinal main girders 2 an 2' which are tubular and cylindrical. In addition to these longitudinal girders 2 and 2' the bridge plates 1 and 1' are held by the support bars 3 an 3' which are parallel to the main girders 2 and 2' can be solid circularly cylindrical bars and extend the full length of the unit, i.e. the full distance from one stand to the other.

According to FIG. 1, the support bars 3, 3' and the main girders 2, 2' are located at the vertices of a trapezoid T.

The main girders 2, 2' can be held by clamping plates 6 against the support bridge plates 1, 1' while screws 7 connect the support bars 3 with the bridge plates 1, 1'. The result is the torsionally stiff framework shown in FIG. 1 which is comprised of two bridge plates 1, 1' as well as the two main girders 2, 2' and the two support bars 3, 3'. The high degree of stiffness of this unit allows the unit to be easily manipulated and lowered in place between the stands and permits the stands to be spaced apart to a greater extent than has been possible hereto.

Assembly time for a frame is thus clearly reduced and the cost of the machine is reduced by reason of the lesser number of intermediate plates required for a particular machine length.

Figure 5:
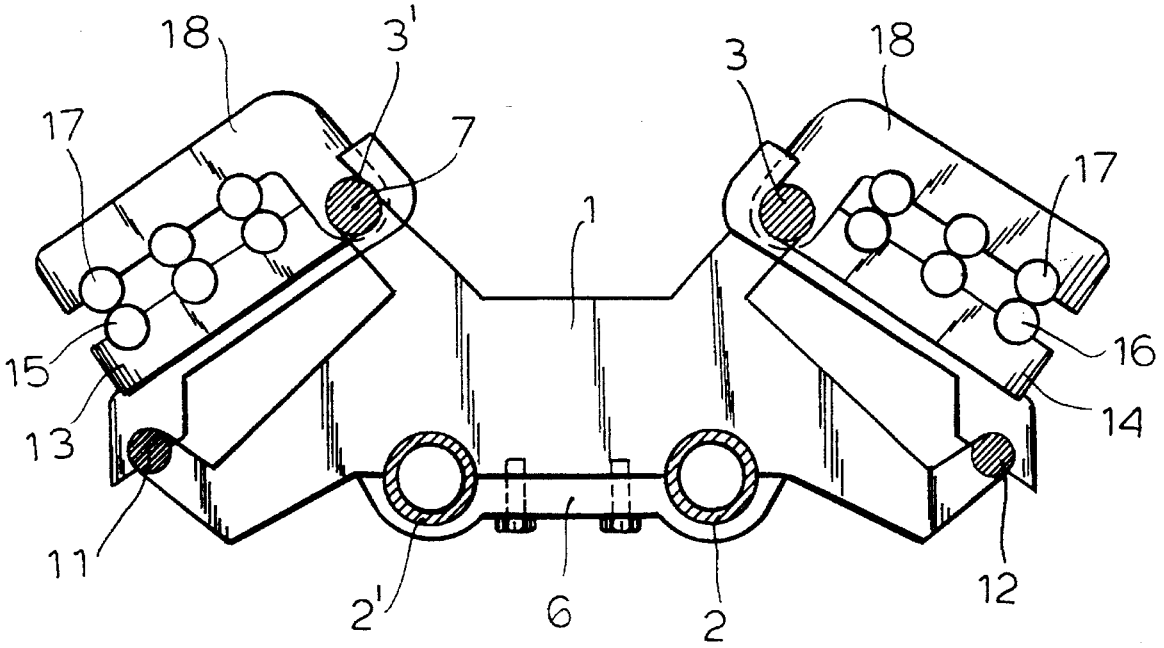
FIG. 5 is a section through the unit of FIG. 1 with the drafting mechanisms mounted thereon.

As can be seen from FIG. 5, the support rollers 15 of the drafting units can be mounted on the lower member 13 of the unit which can be provided with a rod 11 received in the seats 1*e* and 1*f* on the respective side of the machine. The pressing or loading arm 18 with its rollers 17 can be pivotally mounted on the respective holding bar 3 or 3' on which the rear portion of the lower member 13 is mounted as well. The drafting or yarn feed units thus configured may be premounted on the frame work of FIG. 1 before it is affixed between the stands of the machine.

Figure 2:
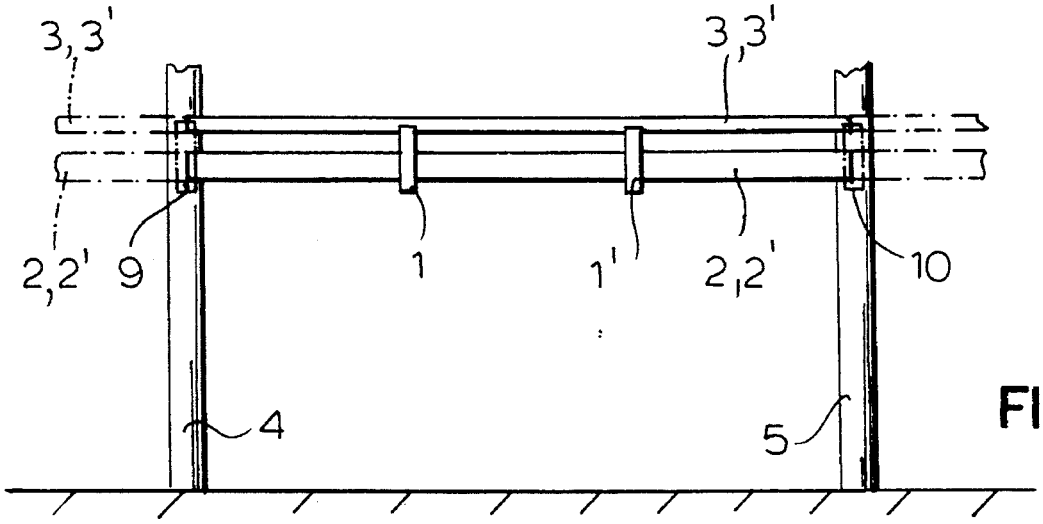
FIGS. 2, 3 and 4 are elevational views in highly diagrammatic form showing respective portions of machine frames in accordance with the invention in three embodiments.

As can be seen from FIG. 2, two bridge plates 1, 1' are provided to define three fields for respective drafting or feed units. In that case, the number of drafting stations n=3 and n−1 equals 2 bridge plates are provided. The bars 3, 3' and the girders 2, 2' each project approximately a third of the length of the mounting unit from the respective bridge plates 1 and 1' and are mounted at their ends on the intermediate stands 4, 5, if desired in portions of these stands which form additional bridge plates reaching to the floor or on which bridge plates are mounted.

Figure 3:
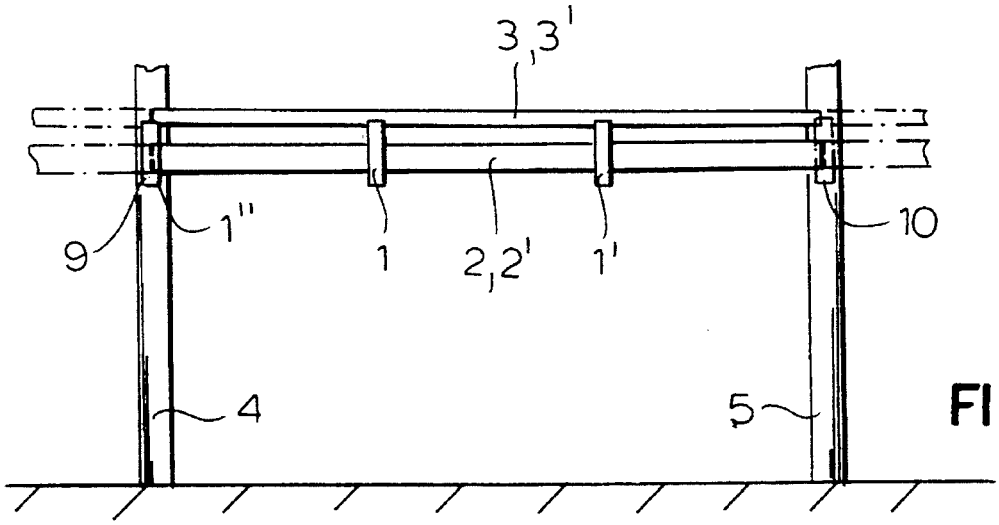

In the embodiment of FIG. 3, three bridge plates are provided, one being seen at 1" mounted on the stand 4 at 9 while the free ends of the bars 3, 3' and the girders 2, 2' are anchored in the bridge plate of the next unit at 10 on the stand 5.

FIGS. 1 and 2, therefore, show the embodiment in which the mounting unit has n drafting fields between two intermediate stands 4, 5 and n–1 bridge plates 1, 1'. In alternatives, n–1 or n+1 bridge plates can be provided.

Figure 4:
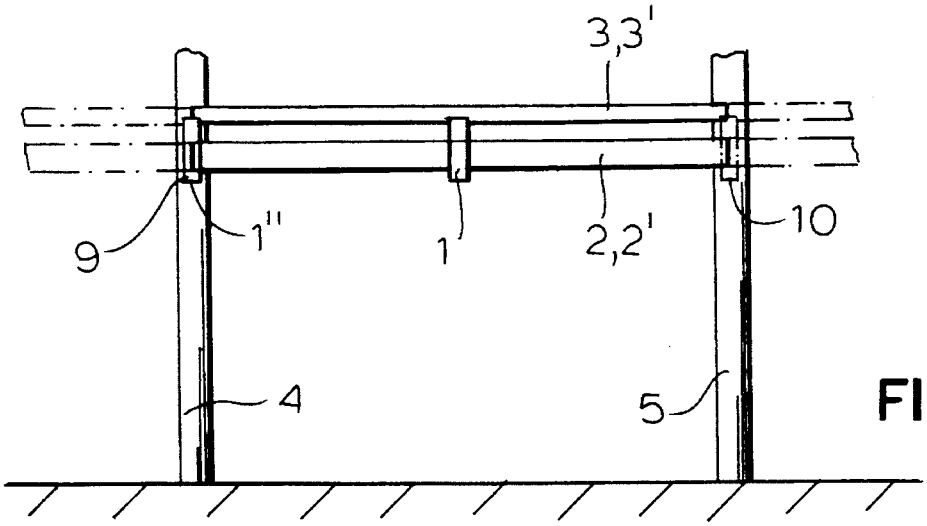

In FIGS. 3 and 4, n bridge plates can be considered to be present as well. In all cases, n can be a whole number up to, say, 6.

We claim:

1. A textile-machine frame, comprising:

a plurality of upright support stands spaced apart over a length of a machine and extending upwardly from a floor on which said stands support the machine;

main girder means extending horizontally and including at least one main girder extending parallel to a longitudinal vertical median plane of said machine perpendicular to said upright support stands and continuously from one support stand to a following support stand along the length of said machine;

at least one stamped bridge plate supported above the floor on said main girder means between each two successive support stands and lying in a plane perpendicular to said at least one main girder to opposite sides of said median plane and opposite working sides of said machine; and respective support bars on opposite sides of said machine carried by said bridge plate, each of said support bars extending in one piece between the two successive support stands and serving to mount support arms with respective drafting rollers and respective loading arms assigned to said support arms with pressing rollers bearing upon said drafting rollers of a respective yarn drafting mechanism.

2. The frame for a double-sided spinning or twisting machine as defined in claim 1 wherein said main girder means includes two main girders symmetrically on opposite sides of said median plane and carrying said bridge plate.

3. The frame for a double-sided spinning or twisting machine as defined in claim 2 wherein said support bars and said main girders are connected to said bridge plate at vertices of a trapezoid.

4. The frame for a double-sided spinning or twisting machine as defined in claim 2 wherein a further stamped bridge plate is supported above the ground on said main girder means between each two successive support stands, is spaced along said main girder means from the first-mentioned bridge plate, is secured to said main girders and said support bars, and lies in a plane perpendicular to said main girders, said bridge plates, said support bars secured to said bridge plates and said main girders secured to said bridge plates forming a manipulatable unit mounted on and between said stands.

5. The frame for a double-sided spinning or twisting machine as defined in claim 2 wherein a number n of drafting stations are provided between each two successive stands, n–1 bridge plates being disposed between each two successive stands, and both ends of each of said main girders and said support bars project beyond said bridge plates and are mounted on said stands.

6. The frame for a double-sided spinning or twisting machine as defined in claim 2 wherein a number n of drafting stations are provided between each two successive stands, n bridge plates being disposed between each two successive stands, one of said bridge plates being mounted at connected ends of said main girders and said support bars, free ends of each of said main girders and said support bars projecting beyond another of said bridge plates, said free ends being mounted on one of said stands, said bridge plate at said connected ends being mounted on the other of said stands.

7. The frame for a double-sided spinning or twisting machine as defined in claim 2 wherein a number n of drafting stations are provided between each two successive stands, n+1 bridge plates being disposed between each two successive stands, said bridge plates including terminal bridge plates connected to ends of said main girders and said support bars, said terminal bridge plates being mounted on said stands.

8. The frame for a double-sided spinning or twisting machine as defined in claim 2 wherein said main girders are connected to said bridge plate by clamping them thereagainst with a clamping plate, said support bars being connected to said bridge plate by screws.

9. The frame for a double-sided spinning or twisting machine as defined in claim 2 wherein said support arms with respective supply or drafting rollers and respective loading arms assigned to said support arms with pressing rollers bearing upon said supply or drafting rollers are mounted on said support bars as premounted units before said support bars and said bridge plate are secured between said stands.

10. The frame for a double-sided spinning or twisting machine as defined in claim 2 wherein said main girder is tubular.

11. The frame for a double-sided spinning or twisting machine as defined in claim 10 wherein said main girder is of circular cross section.

* * * * *